United States Patent [19]

Fischer

[11] Patent Number: 4,589,339

[45] Date of Patent: May 20, 1986

[54] RUBBER BLANKET FOR AN OFFSET ROTARY PRINTING MACHINE

[75] Inventor: Hermann Fischer, Augsburg, Fed. Rep. of Germany

[73] Assignee: M.A.N. Roland Druckmaschinen Aktiengesellschaft, Offenbach am Main, Fed. Rep. of Germany

[21] Appl. No.: 649,899

[22] Filed: Sep. 12, 1984

[30] Foreign Application Priority Data

Oct. 5, 1983 [DE] Fed. Rep. of Germany ..... 3336193

[51] Int. Cl.[4] ..... B41F 5/22; B41F 7/02; B41F 13/08

[52] U.S. Cl. ..... 101/217; 101/376

[58] Field of Search ..... 101/217, 218, 177, 137, 101/142, 143, 154, 395, 396, 375, 376

[56] References Cited

U.S. PATENT DOCUMENTS 2,297,846 10/1942 Van Benschoten ..... 101/177 X
2,995,081 8/1961 Crissy et al. ..... 101/217 X

FOREIGN PATENT DOCUMENTS 129759 2/1978 German Democratic Rep. ..... 101/217
2080204 2/1982 United Kingdom ..... 101/217

*Primary Examiner*—J. Reed Fisher
*Attorney, Agent, or Firm*—Frishauf, Holtz, Goodman & Woodward

[57] ABSTRACT

To relieve stresses within the rubber of a rubber blanket of a rotary offset printing machine, and prevent escape or squeeze-out of the rubber layer as the blanket rotates, the blanket is formed with interruptions or stress reliefs which, when the blanket is laid out flat, are located in zones corresponding to zones of the printed carrier which are free from printed subject matter, for example along fold lines of the carrier, surrounding pictures or non-printed subject matter, or the like. The interruptions or reliefs can be made by milling, for example longitudinal and transverse notches or grooves (2, 3) or by punching holes through the rubber layer (14), the holes being aligned in single or multiple rows along the zones free from printed subject matter. Stresses within the rubber layer, thus, can be relieved not only at the lateral edges, but also inwardly, and centrally, thereby improving overall register of printed subject matter.

15 Claims, 5 Drawing Figures

RUBBER BLANKET FOR AN OFFSET ROTARY PRINTING MACHINE

The present invention relates to a blanket, such as a rubber blanket, for use on the blanket cylinder of a rotary offset printing machine, and more particularly to a rubber blanket which is a composite of a textile substrate and a cover layer of rubber or plastic which transfers ink on the material to be printed, typically on a paper web or paper sheet.

In the specification that follows, and for simplicity, the structure will be referred to as a "rubber blanket" although, of course, materials other than rubber can be used, and the term "rubber" should be understood here to include any suitable printing surface which is ink-accepting. Since, usually, such a surface is rubber, or a rubber-like plastic, the term "rubber" will be used herein.

BACKGROUND

Rubber blankets, when used in rotary printing machines, are subjected to stresses which occur as the rubber blanket cylinder rotates in contact with a plate cylinder. The result of such stresses is the build-up of a bead extending parallel to the axis of the cylinder, which, in due course, results in a lateral squeeze-out or escape of the trailing region of the edge portions of the rubber blanket. These stresses and strains within the rubber blanket may lead to partial failure of proper register. This is particularly noticeable in the region of the printing material which receives ink in the zones of the rubber blanket which tends to form the lateral escape or deflection regions.

THE INVENTION

It is an object to improve an ink-accepting, as defined a rubber blanket cylinder, such that errors and failure of register due to build-up of stresses within the blanket can be avoided.

Briefly, the rubber blanket is subdivided by interruptions, such as notches, grooves, or periodic perforations, which are placed in zones where no ink is to be transferred anywhere, for example in regions where paper is to be folded, in marginal regions, or the like.

Forming grooves, discontinuities or perforations in the rubber coating of the blanket eliminates or at least substantially and effectively decreases the build-up of stresses, and thus strain-like deformation of the rubber coating, which is effective both in circumferential direction of the cylinder as well as in longitudinal direction. The grooves extend, for example, in the form of borders around subject matter where no printing is to be carried out. The decrease in stresses occurs not only once upon each rotation of the blanket cylinder, but already during printing within the zones bordered by the interruptions, such as grooves or other discontinuities of the rubber blanket. The rubber blanket, thus, can relieve stresses which occur in those regions in which no ink is to be transferred to the printed material, for example, in zones which later on are to be folded, where a sheet is to be cut, in margins, or the like. The moduli of elasticity, that is, the E moduli of the underlying textile substrate and of the rubber layer, differ; this difference further contributes to relief of stress on the rubber blanket layer.

DRAWINGS

DETAILED DESCRIPTION

Figure 1:
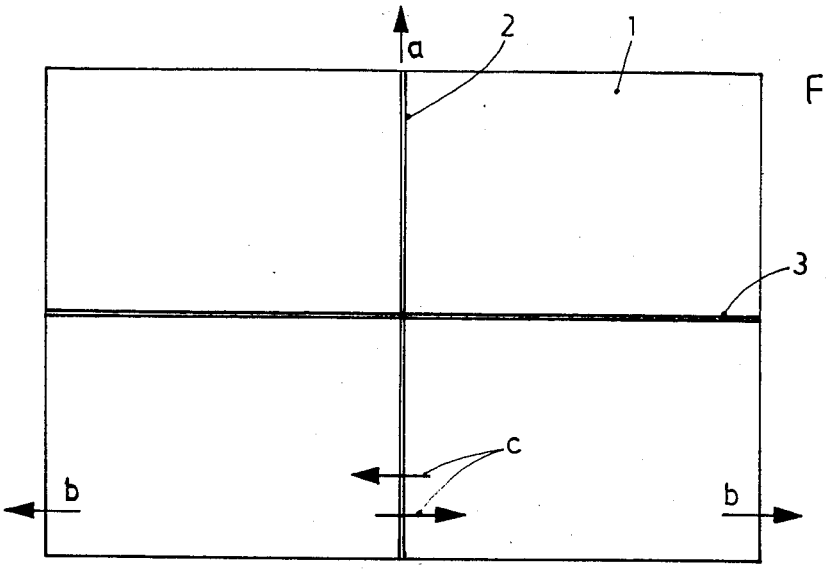
FIG. 1 is a plan view of a blanket in accordance with a first embodiment of the invention.

The rubber blanket 1 (FIG. 1) is formed with two reliefs or interruptions 2, 3 in the form of straight grooves or notches cut into the rubber blanket. The notch 2 is located in that region in which no ink is to be transferred to the printed substrate, for example a web or a sheet of paper, since the substrate is folded with its first longitudinal fold at the region of the notch 2. Similarly, a notch 3, extending transversely to the notch 2, is formed, in which, again, no ink is to be transferred to the substrate since the first transverse or cross fold will be made at that region. Due to this arrangement—the crossed interruptions or reliefs of the rubber layer of the rubber blanket—stresses within the rubber blanket can be reduced already during printing therefrom. The notch 3, particularly, reduces the ridge or bead formed in the direction of the arrow a as the blanket rotates against the printed subject matter and/or the plate cylinder, since, already after half a revolution, the rubber blanket can relieve the stresses arising therein, and the first stress reduction will occur as the interruption or groove 3 passes a printing or subject matter transfer line. The groove or notch 2 permits escape and reduction of stresses in the direction of the arrows c, so that the stresses can be relieved by escape of the rubber beyond its unstressed dimension also centrally, and not only at the edge, in accordance with the prior art, that is, along the arrows b. Any lateral escape or deviation in the direction of the arrows b is substantially reduced.

Figure 2:
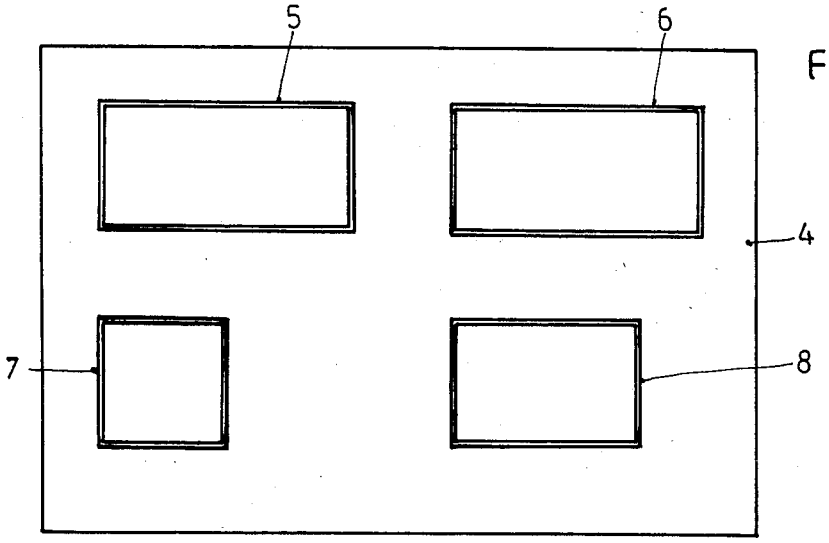
FIG. 2 is a plan view of a rubber blanket, before being wrapped about a cylinder, illustrating another embodiment.

The blanket 4 of FIG. 2 is formed with interruptions or reliefs 5, 6, 7, 8, cut in the form of grooves in regions on which no printing is to be carried out. These grooves 5, 6, 7, 8 border or surround the subject matter to be printed.

The notches 5-8 may be located, for example, in the region of margins of pictures or prints. In contrast to the blanket of FIG. 1, which can be pre-cut and made to print any desired subject matter, the blanket 4 must be specifically arranged and cut for each printing job, since the reliefs or interruptions 5-8 are individually matched to the subject matter to be transferred by the blanket cylinder. The reliefs or interruptions 5-8 again reduce the build-up of stresses within the rubber blanket by permitting slightly lateral escape of rubber material of the rubber layer within central regions or portions of the blanket and not only at the edges.

Figure 3:
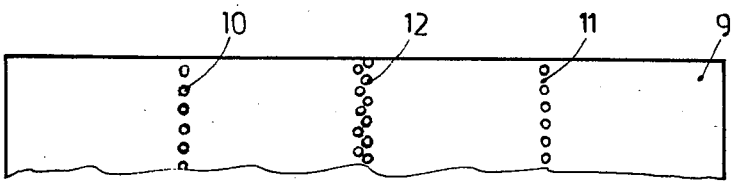
FIG. 3 is a fragmentary view of a portion of the blanket for example of FIG. 1.
Figure 4:
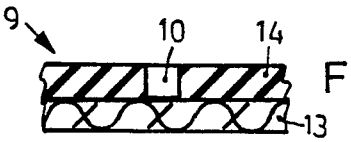
FIG. 4 is a cross section through a relief formed in accordance with FIG. 3.

The reliefs or interruptions need not be continuous grooves; as seen in FIG. 3, the blanket 9 is formed with reliefs 10, 11 which may be constructed as a single-line or track perforation within the rubber material—see perforating lines 10, 11. Rather than using a single line, double or triple or even more lines or rows of perforation openings may be used—see, for example, the central perforation line 12 which may be placed along the first longitudinal fold, for example, corresponding to the position of groove 2 of FIG. 1.

The rubber blanket 9 (FIG. 3) has a textile base or support substrate, and a cover layer 14 of rubber or plastic, that is, of a material which accepts the ink and transfers ink to the print carrier, typically webs or sheets of paper. The reliefs or interruptions 10 are formed as perforations, that is, holes, which extend only within the blanket or rubber layer 14. Such holes can be provided on the blanket layer by punching or stamping, for example, before bonding the rubber layer to the textile substrate 13.

Figure 5:
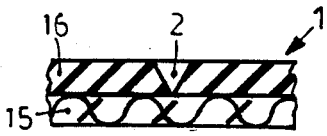
FIG. 5 is a cross section through another form of a relief in the shape of a continuous groove, for example in accordance with FIG. 1.

The reliefs or interruptions 2, see FIG. 1, can be formed also in form of grooves or notches. FIG. 5 illustrates the textile substrate carrier 15 with the cover layer 16 forming the rubber blanket, in which grooves of V-shaped cross section are provided. The reliefs 2 may, of course, be formed differently, for example grooves having rectangular or U-shaped cross section are suitable. The grooves 2 can be made by milling, for example by passing the blanket under a suitably shaped milling cutter. The maximum width of a groove 2, or the diameter of a perforation hole 10, is preferably approximately in the same order as the thickness of the rubber cover layer 14, 16, respectively.

Various changes and modifications may be made, and features described in connection with any one of the embodiments may be used with any of the others, within the scope of the inventive concept.

I claim:

1. For combination with an offset printing machine cylinder of a rotary offset printing machine, a blanket structure comprising a rubber-like cover layer (14,16) of a flexible ink-receiving and transferring material; and a textile base (13,15) located beneath the cover layer, the cover layer and the textile base being bonded together, for printing on a printing carrier of subject matter which leaves selected zones of the printing carrier free from printed subject matter, comprising, in accordance with the invention, means for decreasing stresses arising in the cover layer upon operation of the printing machine including interruptions (2,3; 5–8; 10, 11, 12) formed in the cover layer (14,16) and positioned in non-printing zones corresponding to the zones of the carrier free from printed subject matter.

2. Blanket according to claim 1, wherein the interruptions (2, 3; 5–8) are formed as grooves or notches.

3. Blanket according to claim 1, wherein (FIG. 3) the interruptions are formed as perforating openings or holes located in at least one longitudinal row and penetrating through said cover layer (14).

4. Blanket according to claim 1, wherein the interruptions are located in cutting or folding zones of the carrier.

5. Blanket according to claim 1, wherein the interruptions are formed as continuous milled grooves.

6. Blanket according to claim 1, wherein the interruptions are formed as serially arranged punched perforations extending through the cover layer and located in at least one row positioned parallel to an edge line of the carrier.

7. Blanket according to claim 1, wherein the interruptions extend in a directions parallel to the axis of the cylinder.

8. Blanket according to claim 1, wherein the interruptions extend in a direction circumferentially with respect to the cylinder.

9. Blanket according to claim 1, wherein the interruptions include at least one portion of interruptions extending parallel to the axis of the cylinder and at least one further portion of interruptions extending in a direction circumferentially with respect to the cylinder.

10. Blanket according to claim 7, wherein the interruptions (2, 3; 5–8) are formed as grooves or notches.

11. Blanket according to claim 7, wherein (FIG. 3) the interruptions are formed as perforating openings or holes located in at least one longitudinal row and penetrating through said cover layer (14).

12. Blanket according to claim 7, wherein the interruptions are located in cutting or folding zones of the carrier.

13. Blanket according to claim 8, wherein the interruptions (2, 3; 5–8) are formed as grooves or notches.

14. Blanket according to claim 8, wherein (FIG. 3) the interruptions are formed as perforating openings or holes located in at least one longitudinal row and penetrating through said cover layer (14).

15. Blanket according to claim 8, wherein the interruptions are located in cutting or folding zones of the carrier.

* * * * *